US005190403A

United States Patent [19]

Atkinson

[11] Patent Number: 5,190,403

[45] Date of Patent: Mar. 2, 1993

[54] EROSION PROTECTION DEVICE

[75] Inventor: Francis S. Atkinson, Johns Island, S.C.

[73] Assignee: Atkinson-McDougal Corporation, Philomath, Oreg.

[21] Appl. No.: 712,215

[22] Filed: Jun. 7, 1991

[51] Int. Cl.[5] ..... F02B 3/12

[52] U.S. Cl. ..... 405/29; 405/21; 405/33

[58] Field of Search ..... 405/29, 32, 21, 16, 405/17, 15, 258, 30, 25, 24, 33-35

[56] References Cited

U.S. PATENT DOCUMENTS

| | | | |
|---|---|---|---|
| 315,384 | 4/1885 | Boynton . | |
| 411,704 | 9/1889 | Wurts . | |
| 421,631 | 2/1890 | Sutherland . | |
| 1,577,885 | 3/1926 | Watson . | |
| 1,578,138 | 3/1926 | Kirk . | |
| 1,716,509 | 6/1929 | Smith | 405/52 |
| 1,948,639 | 2/1934 | Youngberg . | |
| 2,055,150 | 4/1936 | Heskett . | |
| 2,097,342 | 10/1937 | Rehfeld | 405/32 X |
| 3,252,287 | 5/1966 | Suzuki | 405/29 |
| 3,380,253 | 4/1966 | Vita | 405/29 |
| 3,415,061 | 8/1966 | Staempfli . | |
| 3,469,403 | 2/1967 | Tanaka . | |
| 3,614,866 | 10/1971 | Kaneko et al. | 405/29 |
| 4,080,793 | 3/1978 | Pulsifer . | |
| 4,129,006 | 12/1978 | Payne . | |
| 4,541,752 | 9/1985 | Phillips . | |
| 4,588,325 | 5/1986 | Seefert . | |
| 5,011,328 | 4/1991 | Atkinson . | |

FOREIGN PATENT DOCUMENTS

| | | |
|---|---|---|
| 607905 | 11/1931 | Fed. Rep. of Germany . |
| 1958814 | 4/1971 | Fed. Rep. of Germany . |
| 760731 | 3/1934 | France . |
| 2476712 | 12/1979 | France . |
| 7931905 | 12/1979 | France . |
| 56-20175 | 11/1982 | Japan . |
| 110507 | 10/1917 | United Kingdom . |
| 168758 | 9/1921 | United Kingdom . |

OTHER PUBLICATIONS

Article entitled, "Teenconstructies langs kanaaloevers van PVC-buizen," *Visser.*

Article in the Feb. 27, 1986, *Sea Technology,* Carter, pp. 36-38, entitled "Pressure-Treated Wood for Marine Applications".

Advertisement for Carthage Mills Incorporated, appearing in *Civil Engineering,* vol. 46, No. 3, Mar., 1976, p. 861.

*Primary Examiner*—Dennis L. Taylor

*Attorney, Agent, or Firm*—Donald J. Verplancken

[57] ABSTRACT

An erosion protection device is provided to control erosion in environments prone to water induced erosion. Each individual device includes a central core area, and six generally equally sized legs projecting outward from the core at equal spacing in each direction. Spacers are provided at the interface of the legs and core. Multiple devices are group together to form a protective nested group to form a protective cover.

10 Claims, 2 Drawing Sheets

EROSION PROTECTION DEVICE

BACKGROUND OF THE INVENTION

This invention relates to the protection of beaches, banks and related structures from wind and water erosion.

The interface of land and water presents serious erosion,or land loss problems. In particular, where waves impact land structures, such as beaches or promontories, the wave energy can disturb the land structure causing the land to erode into the water. The damage caused by this action can take years to accrue, such that the day to day or month to month change is imperceptible, or the damage can be seen in a matter of days where high water or unusually fierce storms generate very high waves.

Where the beach or land adjacent a body of water erodes, valuable real estate and improvements may be permanently lost, or the land may be rendered unsuitable for improvements. Ocean and lakefront property, particularly in scenic areas adjacent large cities, is very valuable. Thus, the constant erosion of land adjacent these waters is a costly problem. Further, where the erosion problem is caused by currents, waves or eddies undercutting banks, shorelines or mounting structures, serious damage to the structures adjacent the undercutting can occur. For example, where a jetty or pier is constructed outward into a body of water, currents and eddies can undermine the soil structure at the lake, river or seabed adjacent the footings or pilings which support the structure. The resulting erosion can undermine the integrity of the structure, requiring filling of the eroded area and repair of the structure and footings or pilings.

Many structures have been proposed to address the wave erosion problem. For example, U.S. Pat. No. 315,384, Boynton, discloses a jetty or breakwater constructed of logs attached together in an A-Frame profile in an attempt to dissipate wave energy prior to it reaching the beach or shoreline. Likewise, U.S. Pat. No. 421,631, Sutherland, discloses a breakwater type structure for dissipating wave energy. With regard to beach placed structures, U.S. Pat. No. 2,055,150, Haskett, discloses a water deflector having a screen mounted to one side thereof. And U.S. Pat. No. 4,129,006, Payne, discloses a triangular structure for erosion control. The device includes multiple triangular modules having slits and baffling therebetween.

Applicant herein is a co-inventor of an off-shore breakwater device and an onshore land building device disclosed in U.S. Pat. No. 5,011,328. These devices use a generally triangular profile and cavity to either dissipate and reflect offshore wave energy, or rebuild beach. Applicant is also the inventor of U.S. Pat. No. Re. 32,663, which discloses an interlocking articulated mat of blocks and inserts used for erosion control. The mat may be used to control erosion on banks, beaches, river beds and the like. Each section of mat consists of a central trilobular core piece and three symmetrical blocks. Each block includes three apertures therein for receiving lobes of the trilobular core piece. By placing an aperture of each block on each lobe of the core piece, a amt section emerges. Each section may then be linked with other cores and blocks, to build continuous mat.

The offshore wave deflection and absorption devices are generally expensive to build and install. While that disclosed in my prior patent of which I am a co-inventor, U.S. Pat. No. 5,011,328, may be built modularly, it must be placed offshore below water and thus may require special permits from federal, state or local governments. Further, the permeable breakwater is designed to protect large stretches of beach or shoreline, and is not intended to protect small discrete segments of beach unless special circumstances are present.

The interlocking mat of my prior invention will protect discrete segments of beach, but is more expensive for protection against major wave attack and difficult to place below water to protect pilings and jetties.

SUMMARY OF THE INVENTION

The present invention will protect discrete segments of beach, or submersed areas and may be easily constructed and transported. The protective cover is provided by nesting a series of six-sided jacks on a beach, or other location, such that a continuous layer of jacks results. Each jack includes a central portion, from which six equal legs radiate outward at equal spacing. The jacks are constructed in mating halves, each having three legs thereon, with a central interlock portion for locking each half to the other mating half. Each jack is then nested with sufficient other jacks to produce a cover, or mat, of jacks sufficiently large to cover the site to be protected. The mat of jacks is placed over a layer of filter fabric, or a graded rock filter.

The use of individual jacks, interconnected in a nested pattern, yields a very high density to absorb and reflect wave energy on the beach, bank or other structure, and protect the underlying land structure. Further, it is believed that the individual jacks may be self nesting, and will interconnect under impact from waves to form the mat or cover of multiple nested jacks. For example, in deep water installation, jacks may be randomly dropped into an area, and will self nest to a certain extent.

The nesting of the jacks may be adjusted by placing spacers at the intersection of each leg pair to adjust the spacing between the legs of each adjacent jack to change the density of the mat or cover. Further, filter fabric may be placed on adjacent jack legs, to catch sand and other particulates to anchor or integrate the mat into the beach.

BRIEF DESCRIPTION OF THE DRAWINGS

For a detailed description of the invention, reference will be made to the following drawings, wherein.

DESCRIPTION OF THE PREFERRED EMBODIMENT

Figure 1:
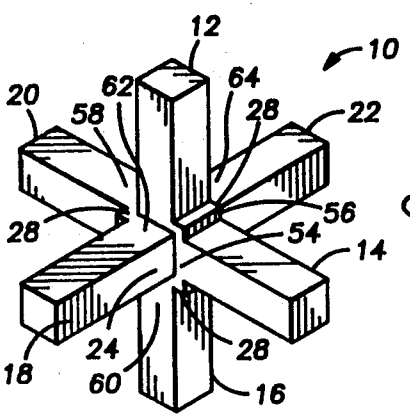
FIG. 1 is a jack constructed in accordance with the present invention.
Figure 3:
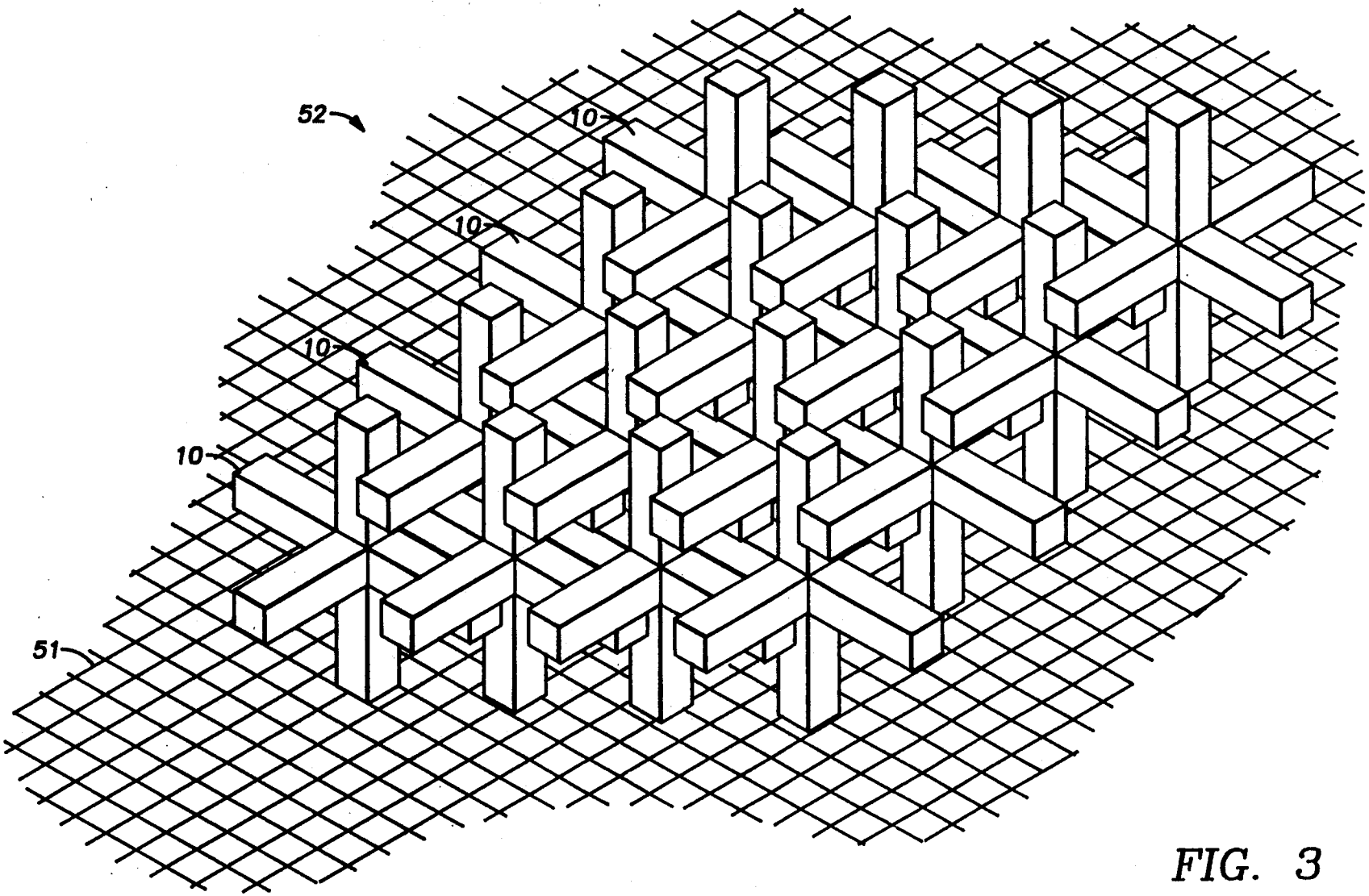
FIG. 3 shows a series of jacks of an alternative embodiment nested in place on a beach, escarpment or underwater soil location.

Referring to FIG. 1, jack 10 is a generally symmetrical member, having six legs 12, 14, 16, 18, 20 and 22 radiating from a central core 24. Each leg 12 to 22 has a generally square cross-section, and each of legs 12 to 22 has approximately preferably the same cross section and length as every other of legs 12 to 22 on core 24. At the intersection of each of legs 12 and 16, and of legs 18 and 22 with core 24, a density spacer 28 is disposed. Density spacer 28 is a block, preferably constructed of the same material as core 24 and legs 12 to 22, and is disposed at the intersection of each leg 12 to 22 and core 24 to space the placement of the legs 12 to 22 of the next adjacent jack 10 when a plurality of jacks 10 are nested to form an erosion cover 52 as shown in FIG. 3. Jack 10, including core 24, legs 12 to 22 and spacers 28 are preferably constructed of concrete, although other materials, such as wood, steel, iron or plastics could be employed without deviating from the invention.

Figure 2:
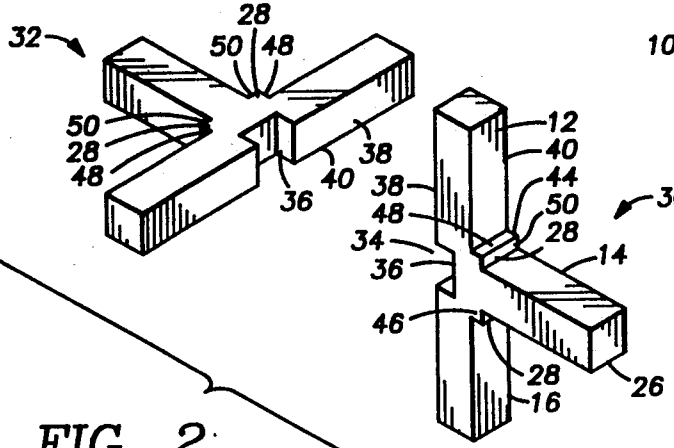
FIG. 2 shows a subassembly of jack halves for joinder into the jack of FIG. 1.

Referring now to FIG. 2, each jack 10 is preferably comprised of jack halves 30 and 32. Each jack halve 30 and 32 is a generally T-shaped member. As halves 32 and 30 are symmetrical, halve 30 will be described, and the same elements and interaction of elements appear in halve 32. Halve 30 is comprised of crossbar portion 40, 42 formed of legs 12 and 16, and stem portion 26 formed of leg 14. A mating core portion 34 is disposed at the intersection of the crossbar 40 and stem 26 of the T, midway between the ends of legs 12 and 16 and opposite the intersection of leg 14 with legs 12 and 16. Mating core portion 34 includes a core recess 36, which is a rectangular notch formed in the mating face 38 of each halve approximately midway between the ends of legs 12 and 16. Density spacers 28 are located at the corners formed by the intersection 44 of leg 12 and leg 14, and the corner formed at the intersection 46 of leg 16 and leg 14. Each density spacer 28 is a generally rectangular section, jutting outward from intersection 44 and 46 and forming leg limit walls 48 and 50 disposed approximately ninety degrees from each other forming a rectangular block projection. Each halve, including legs 12, 14 and 16, core portion 34 and spacers 28 are preferably cast as a single piece of concrete.

To form jack 10, halves 30, 32 are placed adjacent each other in a crosswise fashion, such that legs 14 and 20 are generally colinear and the crossbar portions of each of halves 30, 32 are disposed at a generally right angle to each other. Cement, cement adhesive, or other binding material is then placed in recesses 36, and halves 30 and 32 are adjoined by interlocking at recesses 36 to form jack 10.

Referring to FIGS. 1 and 3, the deployment of multiple, nested jacks 10 to form protected erosion cover 52 is shown. Each jack 10 is placed over a layer of filter fabric, or graded rock filter disposed on the soil, or sand making up the land surface to be protected. Filter fabric 51 is preferably manufactured of polypropylene, and is sized to permit filtration of soil particles while permitting water to pass therethrough. Graded rock filter is prepared from an increasing size of rock in each successive higher layer to filter soil particles from the wave. To adjust the density of the overall cover 52, or percentage of space taken up by jacks 10 relative to the space between jacks 10, the thickness and position of each density spacer 28 may be adjusted. For example, if the rectangular cross-section of density spacer 28 is increased, then the average amount of space between adjacent jacks 10 in the cover will increase, thereby lowering cover 52 density. Contrawise, if the cross-section of spacers is decreased, the space between adjacent jacks will decrease, and the density of cover 52 increases. As shown in FIG. 3, the thickness of the density spacers is zero, yielding the greatest cover 52 density. The position of density spacers 28 relative to the next adjacent jack 10 may be adjusted by the placement and positioning of the jacks 10 in cover 52, thereby also adjusting cover density. Each jack preferably has four density spacers thereon, at the interstices 44, 46 of each jack halves 30, 32. Thus, when halves 30, 32 are joined to form jack 10, six interstices, 54, 56, 58 and 60 are formed at the intersections of legs 12 to 22. These interstices, 54–64, do not include spacers. When jacks 10 are nested to form cover 52, adjacent interstices may be placed in alignment, i.e., interstices 44 of jack halve 30 may always be placed forward and down, such that interstices 46 is facing rearward and down. If all jacks 10 are nested in this configuration, density spacer 28 at interstice 44 on the second jack 10 will engage against the block 28 on interstice 46 of first jack 10. As a result, the adjacent blocks will cause the spacing between adjacent jacks to be two times the thickness of density block 28. If the orientation of the jacks is changed ninety degrees, i.e., density block 28 of first jack 10 is aligned against interstices 54 of the next jack 10, the space between adjacent blocks may be reduced to the thickness of density spacer 28.

Jack 10 may also be modified to provide density spacers at all interstices 44, 46 and 54 through 64. Referring to FIG. 8, an alternative construction of the jack is shown, wherein density spacers are provided at the intersections of each leg 12–22. Athough rectangular density spacers 28 have been described, triangular spacers, having their hypotenuse disposed accross adjacent legs may be used without deviating from the scope of the invention.

Figure 4:
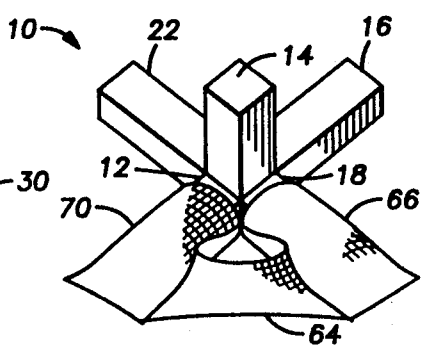
FIG. 4 a front view of the deployment of filter fabric onto adjoining legs of the jack of FIG. 1, for securing an adjacent jack when nested as shown in FIG. 3.
Figure 5:
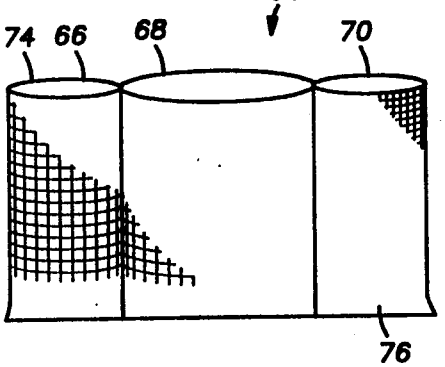
FIG. 5 shows the filter fabric assembled into a pouch prior to assembly onto a jack.
Figure 6:
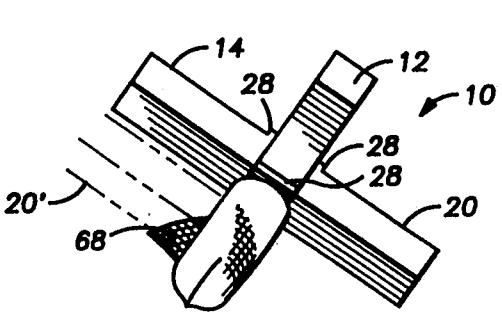
FIG. 6 shows a side view of the jack and fabric of FIG. 4.
Figure 7:
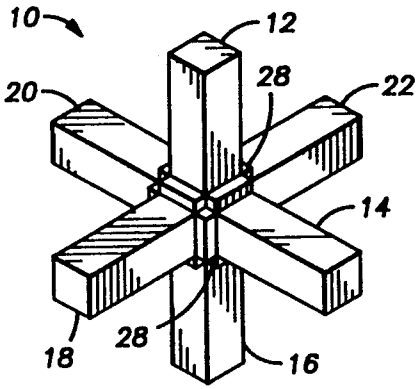
FIG. 7 is an alternative embodiment of the jack of FIG. 1.

Referring now to FIGS. 4 through 6, the use of filter fabric 64 in conjunction with jacks 10 is shown. Filter fabric 64 may be a plastic screen material, which is folded and sewn to form a series of pouches 66, 68 and 70 aligned side by side. Each of pouches 66–70 are open at one end 74, and closed at a second end 76. Pouch 66 is placed over leg 18 of jack 10, and pouch 70 is placed over leg 14 of jack 10. Pouch 68 is fanned open as shown in FIG. 5, and jack 10 is placed on the beach, or land or underwater soil surface to be protected, and leg 20, of the next adjacent jack 10 is placed into pouch 68. Pouch 68 helps anchor jacks 10 in cover 52 to the beach, by trapping sand and other particulates in pouches 44, 48 and 70 as waves or water roll over cover 52. The accumulation of particulates in pouch 68 builds, until legs 14, 16 and 18 are buried in the newly formed soil surface.

Although a preferred embodiment of the invention is shown and described, the invention may be easily modified to fit specific local conditions and materials. For example, pouches 66 to 70 may be made of wire screening. Likewise, the length and cross-section of legs 12–22 may be modified for local conditions. It is contemplated that jacks 10 may be constructed in leg end to end sizes of ten inches to twenty feet for erosion protection purposes.

The use of a multitude of jacks 10, in a grid or cover 52, results in a highly stable, compact erosion protection system which may be manufactured at low cost using a minimum number of components. The geometry of the jacks tends to cause at least three of the legs to become buried in sand, thereby resisting erosion. Further, when combined with the filter fabric, the jack 10 should withstand heavy pounding waves which occur during storms. Finally, the minimal cross-section of each individual jack 10 exposed to wave action should yield a high stability factor, tending to prevent dislocation of the jack 10 during storms and other energy inducing phenomena.

Although the jacks of the present invention might be unwieldy, particularly in large sizes, the modular makeup and assembly thereof provides for relatively easy manufacturer, transportation to the protected site and installation. Because the jack 10 is assembled in halves 30, 32, these halves 30, 32 may be easily stacked for shipment to the appropriate location for assembly. Once halves are transported to the protected site, they may be assembled into individual jacks 10 by interlocking mating core portions 36 thereof and grouting the interface thereof. As each halve 30, 32 is intended to be identical for each size jack 10 being made, all halves are interchangeable. Thus, only two components need to be transported to the protected site for installation, the halves 10 and grout or cement. Once interconnected, jacks may be left adjacent the protective site to cure before ultimate placement.

I claim:

1. An interchangeable member for placement into a grid for protection of a water land interface, comprising:

a central core;

a plurality of legs radiating outward from said core, the intersection of said legs at said core forming an interstice;

a spacing means for spacing the member adjacent other members in the grid disposed at at least one interstice and being formed of a raised portion of said legs at said interstice.

2. The member of claim 1, wherein each of said legs are equal in length.

3. The member of claim 1, wherein said plurality of legs is six legs.

4. The member of claim 3, wherein two of said adjacent legs include a filtering trap thereon, said trap including a filter fabric member open at one end to receive a leg from an adjacent member therein.

5. The member of claim 1, further including a spacing member thereon disposed adjacent the intersection of one of said legs with said core.

6. The member of claim 4, wherein said fabric member includes a pouch disposed between adjacent legs of the member to receive a leg of the next adjacent member in the grid.

7. The member of claim 4, wherein said filter fabric member includes a first, second and third pouch, one of said legs of said member received in said first pouch, a next adjacent legs received in said third pouch, and said second pouch disposed between said legs.

8. An erosion barrier, comprising:

at least two nestable members, each of said members including a central core portion and a plurality of legs radiating outward therefrom;

at least one of said members receiving a filter membrane thereon, and one of said legs of next said member received on said filter membrane on said one member.

9. The barrier of claim 8, wherein said filter member is a porous pouch having opposed pockets for receiving said legs of said one member and an intermediate portion for receiving said leg of said next adjacent member.

10. An interchangeable member for nesting with similar members, comprising:

a first and a second member portion;

each of said member portions including an erosion control profile including a central core and at least two radiating legs radiating from and intersecting at said core;

said cores further including complementary mating profiles for interconnection of said profiles; and, a projection disposed at the intersection of said legs forming a spacing member to space the interchangeable member with respect to adjacently nested interchangeable member by abutting the adjacent member.

* * * * *